United States Patent [19]

Gardner et al.

[11] 4,393,665

[45] * Jul. 19, 1983

[54] SERVER FOR WINE BOTTLES AND THE LIKE

[75] Inventors: James H. Gardner; Noel H. deNevers, both of Salt Lake City, Utah

[73] Assignee: Aurora Design Associates, Inc., Salt Lake City, Utah

[ * ] Notice: The portion of the term of this patent subsequent to Mar. 17, 1981, has been disclaimed.

[21] Appl. No.: 248,816

[22] Filed: Mar. 30, 1981

Related U.S. Application Data

[63] Continuation-in-part of Ser. No. 171,901, Jul. 24, 1980, abandoned, which is a continuation-in-part of Ser. No. 61,655, Jul. 30, 1979, Pat. No. 4,255,944.

[51] Int. Cl.[3] ..... F25D 3/08

[52] U.S. Cl. ..... 62/457; 62/371; 215/6

[58] Field of Search ..... 62/457, 372, 529, 530, 62/459, 463; 220/23.8, 20; 215/6

[56] References Cited

U.S. PATENT DOCUMENTS

| | | | |
|---|---|---|---|
| 1,999,670 | 4/1935 | Strouse et al. | 62/463 X |
| 2,026,449 | 12/1935 | Ward | 215/6 |
| 2,153,255 | 4/1939 | Knott | 62/463 |
| 2,753,990 | 7/1956 | Chalfin et al. | 215/6 X |
| 3,434,302 | 3/1969 | Stoner et al. | 62/530 X |
| 3,676,076 | 7/1972 | Grady | 215/6 X |
| 3,995,445 | 12/1976 | Huskins | 62/530 X |
| 3,998,072 | 12/1976 | Shaw | 62/457 |

FOREIGN PATENT DOCUMENTS

| | | | |
|---|---|---|---|
| 150319 | 8/1937 | Austria | 62/372 |
| 658291 | 7/1965 | Belgium | 215/6 |
| 610315 | 12/1960 | Canada | 215/6 |
| 1127267 | 8/1956 | France | 62/457 |

*Primary Examiner*—Lloyd L. King

*Attorney, Agent, or Firm*—Thorpe, North & Western

[57] ABSTRACT

A server for chilled wine and similar beverages or foods includes a generally cylindrically-shaped side wall into which a bottle or other container may be placed. The side wall is constructed of a heat conductive material such as aluminum, copper, alloys thereof, etc., of sufficient thickness to conduct heat as needed in its long direction. The cooler also includes an ice receptacle which holds the ice either in contact with the side wall or an extension or appendage thereof. The side wall acts to present the wine container with a surface which is at or below the temperature of the wine. This substantially eliminates the transfer of heat by radiation to the wine container. The server also minimizes conductive and/or convective heat transfer between the wine bottle and the surroundings. The side wall of the server surrounds at least about one-half of the height of the enlarged part of the bottle being cooled.

9 Claims, 4 Drawing Figures

SERVER FOR WINE BOTTLES AND THE LIKE

This is a continuation-in-part of co-pending application, Ser. No. 171,901, filed July 24, 1980, now abandoned, which is a continuation-in-part of application, Ser. No. 61,655, filed July 30, 1979, now U.S. Pat. No. 4,255,944.

BACKGROUND OF THE INVENTION

This invention relates to a server construction for efficiently and conveniently maintaining the temperature of chilled wine or other beverage or food in a container.

The conventional way to either chill wine or maintain the coldness of wine while the wine bottle sits on a table, counter, etc., is to place the wine bottle in an ice bucket filled with ice and water. Typically, a cloth napkin is also placed over the wine bottle. This method, although effective, is messy because the bottle and bottle label are made wet, become slippery, and may drip on the table or counter top when removed from the ice bucket. Also, the ice bucket is quite bulky and cumbersome to handle.

A number of proposals have been made for improving upon the above-described methods of serving chilled wine, and some of these are discussed in U.S. Pat. Nos. 2,564,165, 2,068,384, 3,302,428, 4,037,428, 1,999,670 and 3,282,068. These proposals, however, generally either are not very effective in maintaining wine in the chilled condition over desired extended periods, are still bulky and cumbersome, require prechilling of the cooling device and the placement of the cooling medium about the bottle, or generally have the same disadvantages as does the conventional wine cooler or ice bucket, or both. Chilling wine, of course, can easily be accomplished by placing the bottles in the refrigerator some hours before serving. What has been needed is a convenient, compact, attractive, immediately effective, and mess-free arrangement for maintaining the wine at the table or bar at the refrigerator temperature over periods of time of up to two hours.

SUMMARY OF THE INVENTION

It is an object of the invention to provide a new and improved server for chilled wine bottles and similar beverage containers.

It is also an object of the invention to provide a server which will cool or maintain the low temperature of a beverage bottle without making the bottle wet.

It is a further object of the invention to provide a compact attractive server for beverage bottles.

It is an additional object of the invention to provide a server which surrounds a sufficient portion of a beverage bottle to maintain the low temperature of the bottle.

The above and other objects are realized in a specific illustrative embodiment of a server which includes a housing open at the top for receiving a bottle to be cooled and having a side wall shaped to conform to and surround the side exterior of the bottle. The height of the side wall is at least about one-half the height of the enlarged portion of a typical beverage bottle so that when the bottle is placed in the housing, the side wall surrounds the bottle up to about one-half the height of the enlarged portion. The side wall is made of a heat conductive material such as aluminum, copper, silver, etc., of sufficient thickness to conduct heat as needed in its long direction and circumferentially. The server also includes a receptacle for holding ice in contact with the side wall. The side wall is thus cooled by the ice in the receptacle to thereby present to the bottle a surface area at or below the desired serving temperature. Radiative heat transfer to the bottle is thus generally prevented, and the trapped air layer between the side wall and the bottle inhibits conductive or convective heat transfer to the bottle. In this manner, the bottle may be maintained at close to a refrigerator temperature for fairly long periods of time or, if the bottle is initially warmer than refrigerator temperatures, it can be slowly cooled. This is accomplished with very compact, esthetically pleasing structure.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Various embodiments of the present invention are shown in the accompanying drawings and will be described herein. The common features of the embodiments are the employment of a housing having a side wall for surrounding a bottle to be maintained cool or cooled, and the provision of an ice receptacle for holding ice in contact with the side wall. The side wall is made of a thick piece of heat conducting material such as aluminum, copper, silver, etc., which facilitates conducting heat originating either from the bottle or from the surrounding environment to the ice to thereby cool the bottle or interfere and inhibit ambient heat from reaching the bottle. In this fashion, a bottle of wine or similar beverage may be effectively maintained at a cool temperature without the attendant mess associated with the conventional ice bucket.

Figure 1:
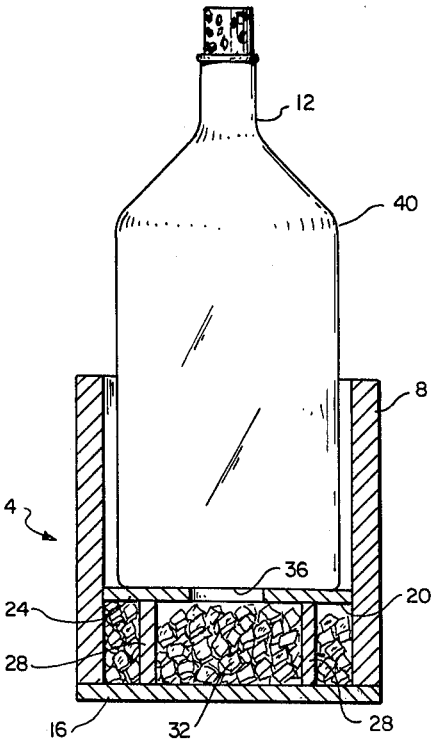
FIG. 1 shows a side, cross-sectional view of a server made in accordance with the principles of the present invention.

Referring now to FIG. 1, there is shown a side, cross-sectional view of a server housing 4 which includes a fairly thick-walled cylindrical shell 8 which is open at the top to allow placement therein of a bottle of wine 12 or similar beverage container. The housing 4 also includes a bottom wall 16 which is joined to the bottom of the cylinder 8 to form a water-tight container. The cylinder 8 and bottom wall 16 are made of a heat conducting material such as aluminum, copper, silver, etc., for purposes to be described hereinafter.

A support structure 20 is disposed at the bottom of the cylinder 8 to provide support for the bottle 12. This support structure could take a variety of forms including that of an annular disc 24 whose perimeter is joined to the interior surface of the cylinder 8 as shown in FIG. 1. The disc 24 could be further supported (or alternatively solely supported) by rod-like elements 28 extending from the bottom wall 16 upwardly to the bottom surface of the disc 24. Advantageously, the support structure 20 is also made of a heat conducting material.

In use, ice 32 is placed in the bottom of the housing 4 as shown and a bottle to be cooled or whose temperature is to be maintained cool is placed in the housing on the support structure 20. If the temperature of the bottle 12 is greater than that of the housing 4, then heat from the bottle will radiate to the cylinder 8 and be conducted downwardly to the ice 32. Similarly, ambient heat will in large degree be intercepted by the cylinder 8 and likewise conducted downwardly to the ice 32.

It has been found that suitable cooling of a beverage can be achieved if the side wall of a server surrounds at least about one-half of the height of the enlarged part of a bottle containing the beverage (that part of the bottle 12 between the bottom 36 and shoulder 40). For bottles which do not have distinct "enlarged parts", it has been found that the server cools suitably if the side wall surrounds at least about one-half the height of the beverage in the bottle.

For an aluminum server of the type shown in FIG. 1, having a 4.5" outside diameter, a 0.063" wall thickness, and an ice reservoir depth of two inches, the effects of different side wall heights was tested for a standard one liter carafe filled to the shoulder with wine. The shoulder height was about five inches. The tests were conducted at approximately 50% relative humidity and at an ambient room temperature of from 72 to 79 degrees F. The initial temperature of the wine was 40 degrees F. The temperature rise of the wine over a period of time was measured by centering a temperature-detecting thermocouple in the wine. Results of the tests were as follows:

| Height of Server Side-wall on Carafe | Temperature Rise in Degrees F. After: 15 min. | 30 min. | 60 min. |
|---|---|---|---|
| 5.5 inches | .6 | 1.4 | 3.2 |
| 3.5 inches | .6 | 1.4 | 3.2 |
| 2.6 inches | 1.7 | 3.1 | 6.3 |
| 0 inches (bare carafe) | 4.5 | 8.7 | 13.1 |

As can be seen from these results when the height of the server wall on the carafe was 2.6 inches (about fifty percent of the enlarged part of the carafe), substantial cooling is maintained over an hour period, with the rise in temperature being only 6.3 degrees F. When the carafe is completely exposed, the temperature rise of the wine over an hour period is 13.1 degrees F.

Figure 2:
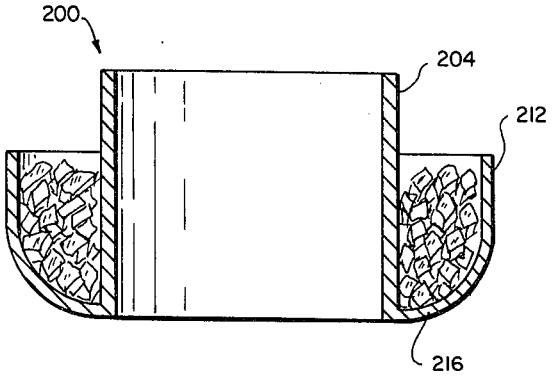
FIG. 2 is a side, cross-sectional view of an embodiment of the present invention in which the ice receptacle is located about the exterior of the primary server housing.

FIG. 2 shows a sectioned view of a server in which a bottle rests directly on the table or counter top within the cooler housing 200. The housing 200 is formed in the shape of a hollow cylinder with a side wall 204 made of a heat conducting material. Formed to circumscribe the outside of the side wall 204 is an ice receptacle also having a side wall 212 and a bottom wall 216. The height of the side wall 212 of the ice receptacle is not as great as that of the side wall 204 and so ice in the receptacle is maintained in contact only with the lower portion of the side wall 204. However, since the side wall 204 is thick and made of a heat conducting material, heat from the bottle or surroundings is readily conducted to the ice in the receptacle.

Because the housing of FIG. 2 is open at the top and bottom so that the bottle may rest directly on the table or counter top, the height of the housing can be substantially reduced. This is because there is no need for a compartment below the bottle to hold the ice. It may be desirable, however, to include a wall at the bottom of the housing 200 on which a bottle could rest. This would not substantially increase the height of a bottle being cooled and would allow carrying the bottle in the housing.

Figure 3:
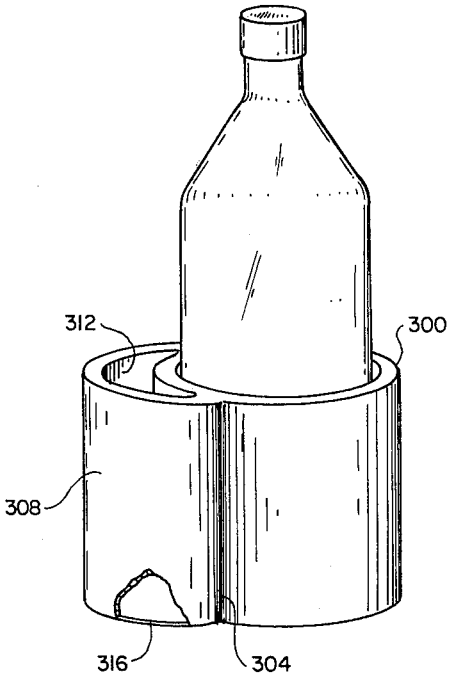
FIG. 3 is a perspective view of an additional embodiment of the server of the present invention.

FIG. 3 shows still another embodiment of a server which includes a cylindrical shell 300 open at the top for receiving a bottle of wine or other beverage. The shell 300 is constructed of a thick heat conducting material. Projecting outwardly from the exterior surface of the shell 300 along a generally vertical line 304 and curving about a portion of the side wall of the shell 300 to again join to the exterior surface of the shell as an outer wall 308. The outer wall 308, which in FIG. 6 is substantially the same height as the shell 300, defines a space 312 between the outer wall and the shell for receiving ice. The outer wall 308 could be made of a heat conducting material or alternatively of a non-heat conducting material such as plastic or other synthetic or natural material. A bottom wall 316 joins the bottoms of the outer wall 308 and a portion of the shell 300 to support and maintain ice in the space 312. The outer wall 308 can have a variety of shapes to hold ice into contact with a portion of the shell 300 to thereby cool the shell as previously described.

Figure 4:
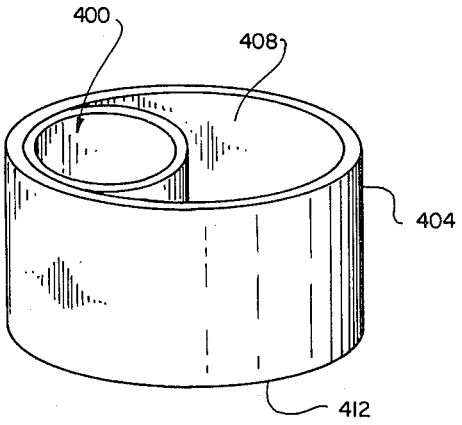

Finally, FIG. 4 shows a perspective view of another embodiment of the present invention wherein the ice is maintained in contact with a portion of a side wall of the server. This embodiment includes a cylindrical housing 400 for receiving a beverage bottle. The housing 400 is made of a heat conductive material. Circumscribing the housing 400 is an outer wall jacket 404 whose top cross-section is oblong or elliptical. The housing 400 is disposed in one end of the elliptical outer wall formation so that a portion of the side of the housing is in contact when joined to a portion of the interior surface of the jacket 404 as shown. The outer wall 404 could be made of a heat conducting material or, alternatively, a non-heat conducting material such as plastic or other synthetic material.

A receptacle space 408 is defined between the housing 400 and the outer wall 404 at the other end of the elliptical outer wall formation to receive ice for the same purpose as described for the FIG. 3 embodiment. A bottom wall 412 for this receptacle space is provided to support the ice.

Tests were conducted for the server construction shown in FIG. 3, for an aluminum server having a side wall thickness of 0.125" and an outside diameter of 4 inches. The tests were conducted for a 750 ml (Gallo) white wine bottle containing wine at the level of the shoulder of the bottle, which was about seven inches in height. Again, the tests were conducted at approximately 50% relative humidity and at an ambient room temperature of from 72 to 79 degrees F. The initial temperature of the wine was 40 degrees F. The temperature rise of the wine was again measured by way of a thermocouple placed in the wine. Results were as follows:

| Height of Server Side-wall on Bottle | Temperature Rise in Degrees F. After: 15 min. | 30 min. | 60 min. |
|---|---|---|---|
| 6.0 inches | .2 | .4 | 1.0 |
| 5.0 inches | .2 | .4 | 1.0 |
| 4.25 inches | .7 | 1.4 | 3.2 |
| 3.5 inches | 1.5 | 3.4 | 6.4 |
| 0 (bare bottle) | 3.6 | 8.1 | 13.8 |

When the server covered about one-half the height of the enlarged part of the bottle (3.5 inches), the rise in temperature of the wine was 6.4 degrees F. over an hour period, compared to a rise of 13.8 degrees F. for a completely exposed bottle.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A server for wine bottles and the like comprising a housing open at the top for receiving a bottle and having a side wall shaped to conform to and surround the side exterior of the bottle and a bottom wall joined at its perimeter to said side wall, said side wall having a height of at least one-half the height of the enlarged portion of the bottle and being made of a heat conductive material, the side wall and bottom wall forming a receptacle means for holding ice in contact with said side wall to cause said side wall to absorb heat from the bottle if the bottle is at a higher temperature than the side wall, and to substantially prevent the transfer of ambient heat to the bottle, and support means within said housing above said bottom wall to hold the bottle above and out of contact with the ice, said support means having openings therein to allow placement of ice into the receptacle means through the top opening of the housing.

2. A server for wine bottles and the like comprising a vertically elongate housing open at the top for receiving a bottle and having a side wall for surrounding the entire side exterior of the bottle, said side wall having a height of at least about one-half the height of the enlarged portion of the bottle and being made of a heat conductive material to enable circumferential conduction in the side wall, and receptacle means for holding ice in contact with a side portion of the exterior of said side wall to cause said side wall to absorb heat from the bottle if the bottle is at a higher temperature than the side wall, and to substantially prevent the transfer of ambient heat to the bottle, said receptacle means including an outer wall joined to and formed to surround said side portion of said side wall to define a space between said side portion of the side wall and the outer wall for receiving ice, said outer wall being joined to the side wall at a first generally vertical locus of points, and then looping outwardly from the first locus of points and about said space, and joining the side wall at a second generally vertical locus of points spaced horizontally from the first locus of points, and a bottom wall joining the bottoms of the outer wall and side wall to support ice placed in the space between the outer wall and side wall.

3. A server as in claim 2 wherein said housing is cylindrical in shape, and wherein said outer wall is semi-cylindrical in shape.

4. A server as in claim 3 wherein said housing and outer wall are constructed of extruded aluminum.

5. A server as in claim 1 wherein said support means comprises an annular disc whose perimeter is joined to the interior surface of said side wall.

6. A server as in claim 5 wherein said annular disc is disposed about 2 inches above said bottom wall.

7. A server as in claim 1 wherein said side wall has a thickness of about 0.06 inches.

8. A server as in claim 4 wherein said side wall has a thickness of about 0.125 inches.

9. A server as in claim 2 wherein said housing is constructed of aluminum, and said outer wall is constructed of plastic or like material.

* * * * *